United States Patent [19]

Dola et al.

[11] Patent Number: 4,640,569

[45] Date of Patent: Feb. 3, 1987

[54] ADAPTOR FOR COUPLING A CABLE TO A CONNECTOR

[75] Inventors: Frank P. Dola, Hudson; Paul P. Siwinski, Seminole; Grover A. Zwieg, Clearwater, all of Fla.

[73] Assignee: AMP Incorporated, Harrisburg, Pa.

[21] Appl. No.: 716,779

[22] Filed: Mar. 27, 1985

[51] Int. Cl.[4] ..... H01R 4/66

[52] U.S. Cl. ..... 339/143 R; 339/14 R; 339/141

[58] Field of Search ..... 339/14 R, 17 F, 176 MF, 339/143 R, 141

[56] References Cited

U.S. PATENT DOCUMENTS

| | | | |
|---|---|---|---|
| 3,944,317 | 3/1976 | Oberdiear | 339/143 R |
| 4,272,148 | 6/1981 | Knack | 339/103 R X |
| 4,398,780 | 8/1983 | Novotny et al. | 339/143 R X |
| 4,508,415 | 4/1985 | Bunnell | 339/176 MF X |

FOREIGN PATENT DOCUMENTS

| | | | |
|---|---|---|---|
| 2109648 | 6/1983 | United Kingdom | 339/143 R |

*Primary Examiner*—Eugene F. Desmond

*Attorney, Agent, or Firm*—Robert W. Pitts

[57] ABSTRACT

An adaptor to couple a connector to a conductor of a flat, high performance, electrical cable is disclosed. The adaptor includes two mating halves through which the conductors pass. The adaptor is formed with an internal recess and further includes a ferrule therein to allow an electrical ground connection to an EMI shield of the cable. The adaptor is also formed with external threads whereby a threaded nut may be employed to maintain the adaptor halves operatively couples. The connector can then be attached to components of an electrical system without significant radiation occurring at the interconnection.

21 Claims, 11 Drawing Figures

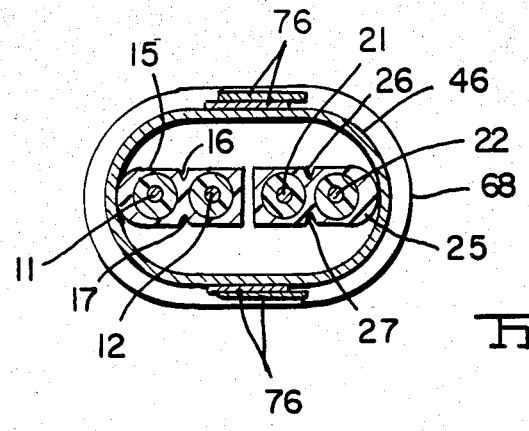
Fig. 8
Fig. 9
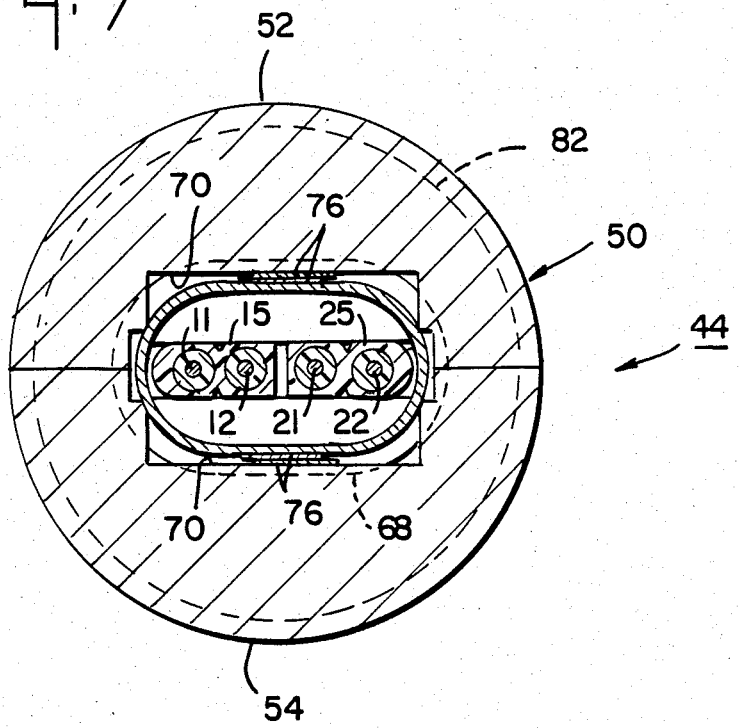

ADAPTOR FOR COUPLING A CABLE TO A CONNECTOR

BACKGROUND OF THE INVENTION

1. Field of the Invention

This invention relates to an electrical adaptor to facilitate the coupling of a high performance flat cable to a connector for subsequent coupling to a component of an electrical system. The cable end to be coupled has stripped therefrom insulation to expose insulated conductive wires and strips of EMI shield.

2. Description of the Prior Art

Conventional multiconductor cables for transmitting high frequency electrical signals include both shielded twisted pair cables and coaxial cables. Such cables have their greatest utility in transmitting electrical signals between electrical components. Such transmitted signals can be in digital form although such transmitted signals may also be in analog form.

Shielded twisted pair cables utilize a pair of insulated conductive wires in a twisted pair configuration with a grounded, electrically conductive shield around each twisted wire pair. The shield functions to reduce electromagnetic interference radiation, generally called EMI, which naturally emanates from signal transmitting wires and which might otherwise adversely affect the performance of adjacent electronic devices. Such shield also functions to minimize cross talk, electrical interference between one pair of wires and an adjacent pair which would tend to impair the fidelity of the signals being transmitted. Shielded twisted pair cables are a type of a differential transmission system where both wires are electrically powered and both constitute signal carrying wires. The information transmitted is a function of the sequential voltage differential between the two wires of the pair. An example of a shielded twisted pair cable is described in U.S. Pat. No. 4,404,424 issued to King et al.

In a manner similar to shielded twisted pair cables, coaxial cables use an EMI shield to reduce radiation. But in coaxial cables, unlike shielded twisted pair cables, only one electrically powered signal wire is utilized. The signal wire is encased in insulation which is surrounded, in turn, by the grounded, electrically conductive shield. In coaxial cables, the shield also functions as a grounded reference for the voltage of the signal wire. An example of a coaxial cable is described in U.S. Pat. No. 3,775,552 issued to Schumacher.

Considerable effort has been extended to develop a flat coaxial cable which would yield the same performance characteristics as conventional coaxial cable but which would also enable the use of conventional mass stripping and termination techniques to thus facilitate the coupling of an electrical connector to the cable. Consider for example U.S. Pat. No. 4,488,125 to Gentry et al. Other flat coaxial cables are disclosed in U.S. Pat. Nos. 4,487,992 and 3,775,552.

One application for flat cable is in under the carpet wiring situations in which a flat, low profile cable is extended beneath a carpet for connection to, and coupling of, components of an electrical system.

Shielded twisted pair cables do not have a low profile suited for use in undercarpet applications since twisted wires are continuously and sequentially located above, to one side, below, and to the other side of each other along the length of the cable. As a result, the cable thickness periodically increases to a double wire thickness along the length of the cable. This arrangement of signal wires thus precludes low profile cable configurations since low profile cable configurations are possible only in cables having their wires spaced parallel to each other in a single, usually horizontal, plane. The configuration and orientation of wires in a shielded twisted pair cable also precludes mass stripping and termination since the positioning of any one wire with respect to another varies as a function of where the cable is cut along its length.

While many types of adaptors and connectors and cables have been proposed in the past, the instant inventive adaptor is particularly well-suited for the high performance cable, equivalent in performance to a shielded twisted pair cable, to a connector of the type disclosed in U.S. Pat. No. 4,449,778 for subsequent coupling to a component of an electrical system, the cable having at its endto be coupled, stripped pairs of associated insulated wires and pairs of strips of EMI shield.

The coupling of the stripped cable ends to a connector is disclosed in U.S. Pat. No. 4,449,778 to Lane. According to that disclosure, the end of the cable has its conductive shield encompassed by ferrule which is then press fit into association with spring biased supports to complete the ground. The various discrete conductive wires may then be placed in proper position within a connector for future coupling to an electrical device, as for example components of an electrical system between which signals are to be transmitted.

SUMMARY OF THE INVENTION

The preferred embodiment of the instant invention comprises an adaptor for use in joining a plurality of electrical conductors of a cable to a connector. The adaptor comprises a generally cylindrically shaped, hollow, electrically conductive ferrule through which the insulated wires of a cable may pass. The ferrule also provides means to establish an electrical gounded contact between grounding strips of the cable and the adaptor body. An adaptor also includes a body formed of separable portions or halves shaped for mating engagement one with another with each portion having an internal recess for the reception of the ferrule therein. Securement means are also provided to hold the portions of the body in operative engagement with the ferrule located within the recess of the adaptor body. The securement means includes tapering threads formed on the inboard end of the separable portions and a nut with internal threads to engage the tapering threads to releasably couple the separable portions. A shoulder is located on the separable portions to limit the rotational movement of the nut with respect to the threads and the separable portions. Coupler plates are also provided on the outboard ends of the separable portions for the securement of the adaptor to a connector. When secured together by the securement means, the portions form a first aperture at the inboard end of the adaptor and a second aperture at the outboard end of the adaptor for frictionally securing a cable segment passing through the adaptor. At least one female receptor is operatively coupled with at least one male projection within the adaptor for piercing a cable extending between the first and second apertures to preclude longitudinal movement of a cable segment with respect to the adaptor. The present invention may also be considered as an adaptor for joining, to a connector, a cable stripped to provide at least two pair of associated conductive wires and at least two conductive strips from EMI shields. The adaptor includes a generally cylindrically shaped, hollow, ferrule through which the insulated wires of a cable may pass for coupling with a connector and for providing electrical grounded contact for overlapped conductive strips of the EMI shields to the adaptor. The adaptor also includes an adaptor body formed of separable, essentially symmetric halves with the halves being provided with male and female members to ensure the aligned engagement of the halves. The halves are also provided with an internal recess for the receipt of the ferrule. The ferrule is essentially oval-shaped in cross section with enlarged ribs front and rear. The recess is formed with ridges front and rear for the receipt of the ribs of the ferrule. When the halves are operatively secured together with the ferrule therebetween, sufficient force is generated to deform the ferrule to essentially conform to the shape of the recess and to compress, between the ferrule and the recess of one half, a first crossed pair of conductive strips of the EMI shields, and to compress, between the ferrule and the recess of the other half, a second crossed pair of conductive strips of the EMI shield.

BRIEF DESCRIPTION OF THE DRAWINGS

FIGS. 8 and 9 are cross-sectional views of the adaptor of the present invention taken through line 8—8 of FIG. 3 and through line 9—9 of FIG. 4, respectively.

DESCRIPTION OF THE PREFERRED EMBODIMENT

The multilayer shielded pair cable to be coupled to an adaptor in accordance with the teachings of this invention provides a controlled, high impedance, low cross talk, low attenuation, balanced multiconductor flat cable suitable for use in transmitting digital or other high frequency signals. The cable will be described in terms of a flat cable having two separate pairs of associated wire conductors, four conductors in all. It should be understood, however, that some applications may require cable having more than just two pairs of conductors. This invention is consistent with the use of coupling any number of pairs of conductors and can be employed with a single pair of conductors or with a large number of pairs. Indeed, this invention is intended for use in applications requiring three or more pairs of conductors or even one pair in a manner similar to the use of the two-pair cable.

Figure 1:
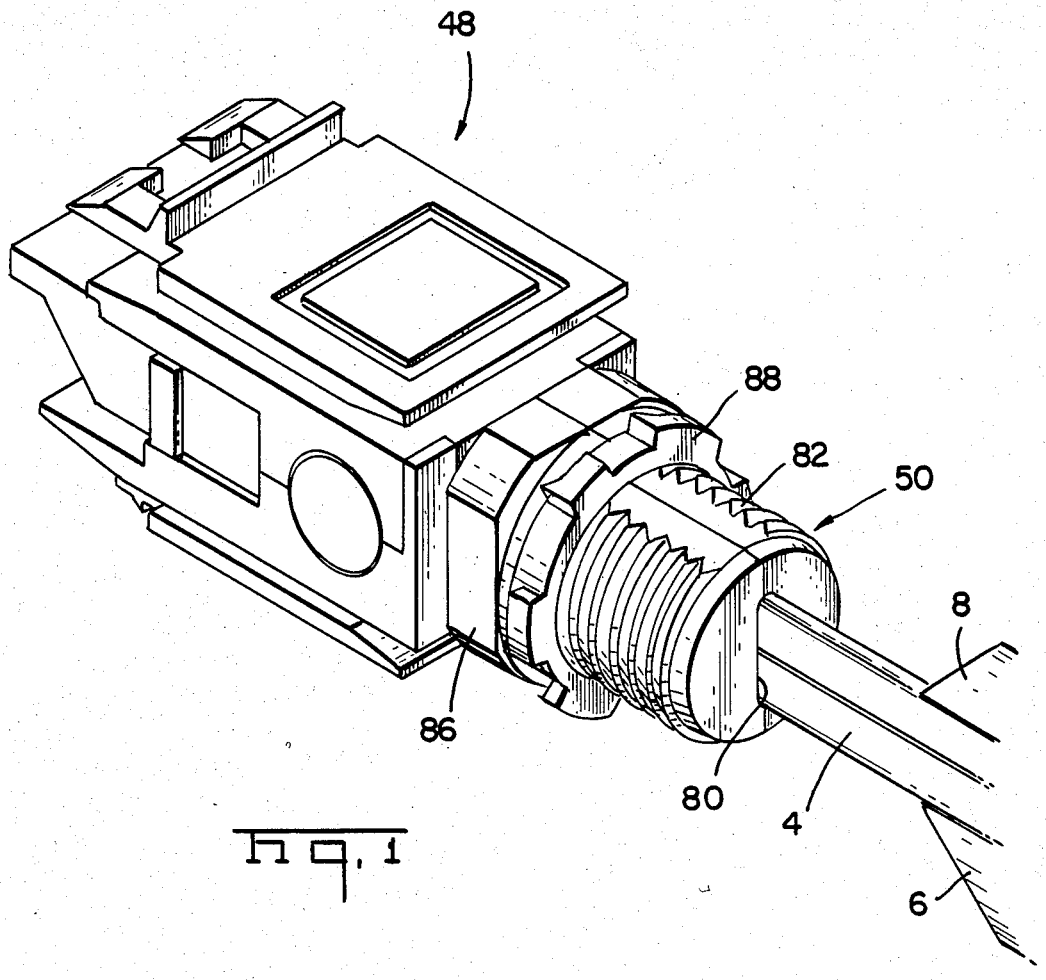
FIGS. 1 is a perspective showing of an adaptor in operative association with a cable and connector, the adaptor being constructed in accordance with the teachings of the present invention.
Figure 2:
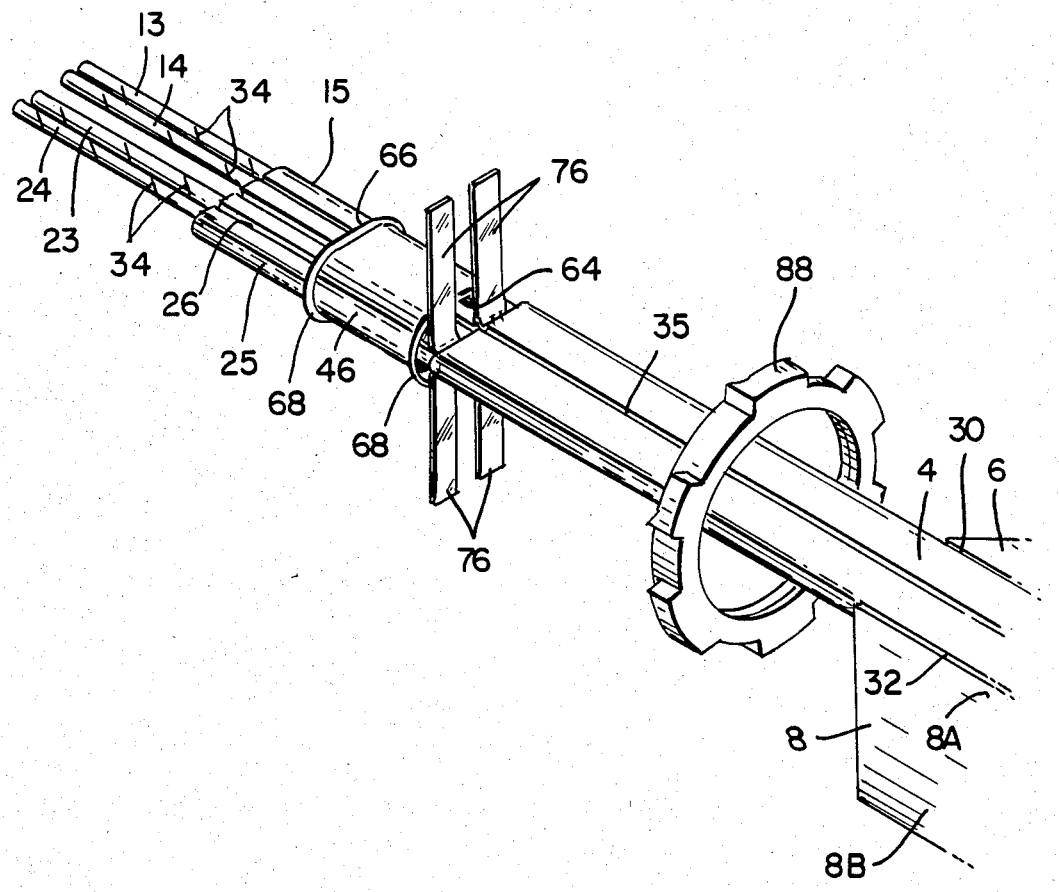
FIG. 2 is a perspective showing of the cable, ferrule and locking nut of the present invention prior to the installation of the body of the adaptor.
Figure 3:
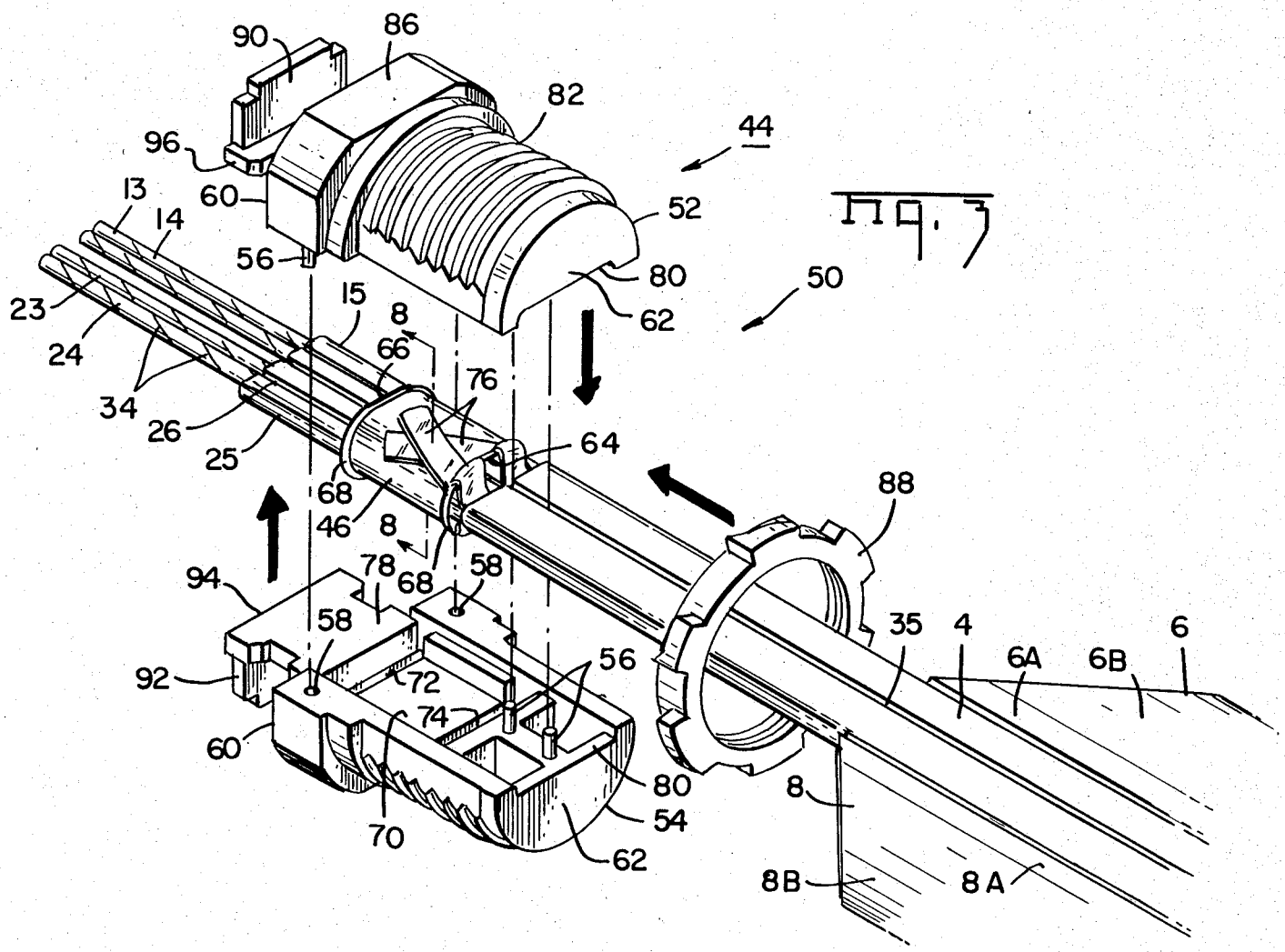
FIGS. 3 through 7 are perspective showings of the adaptor of the present invention in varying stages of coupling to a connector.
Figure 4:
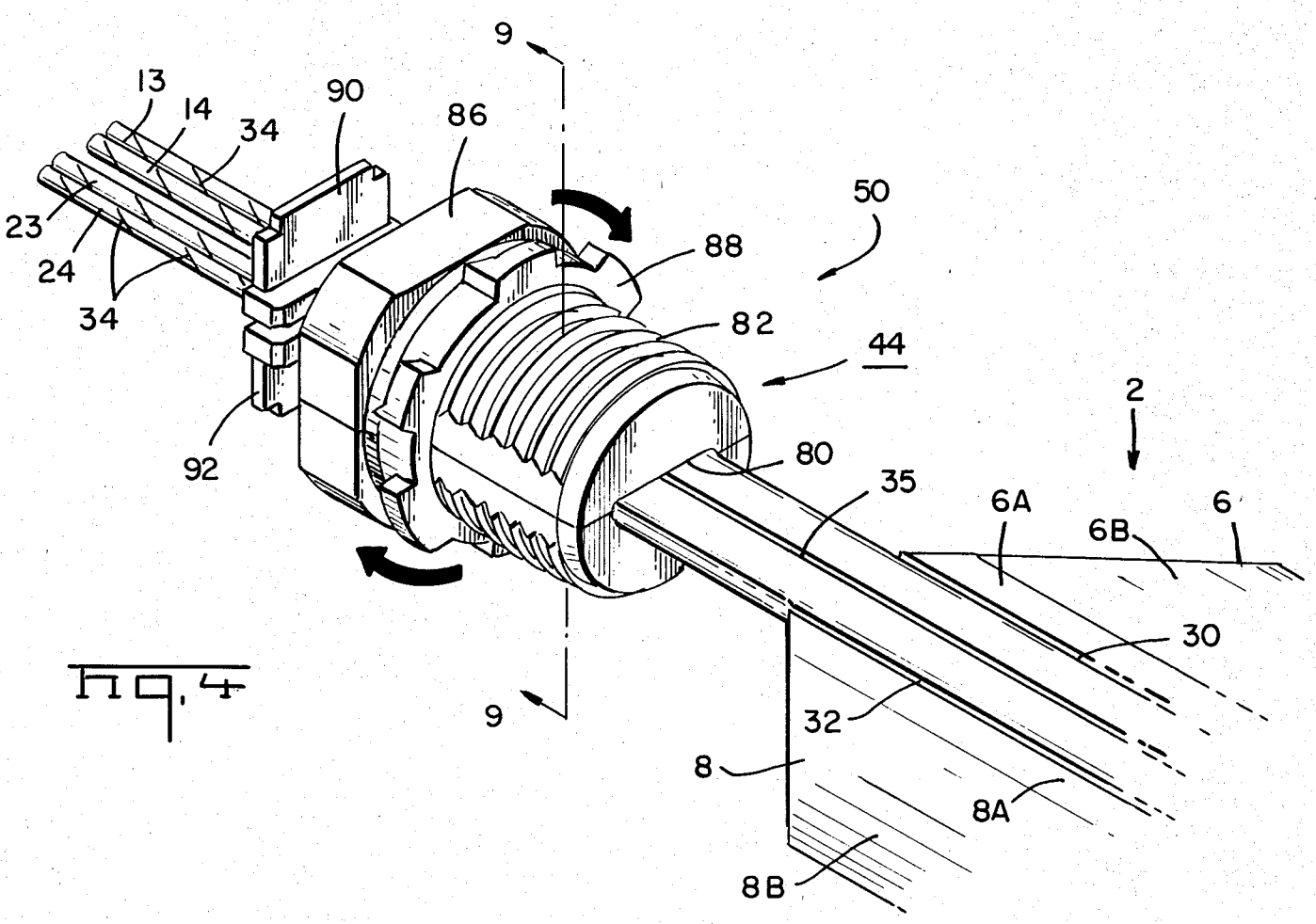
Figure 5:
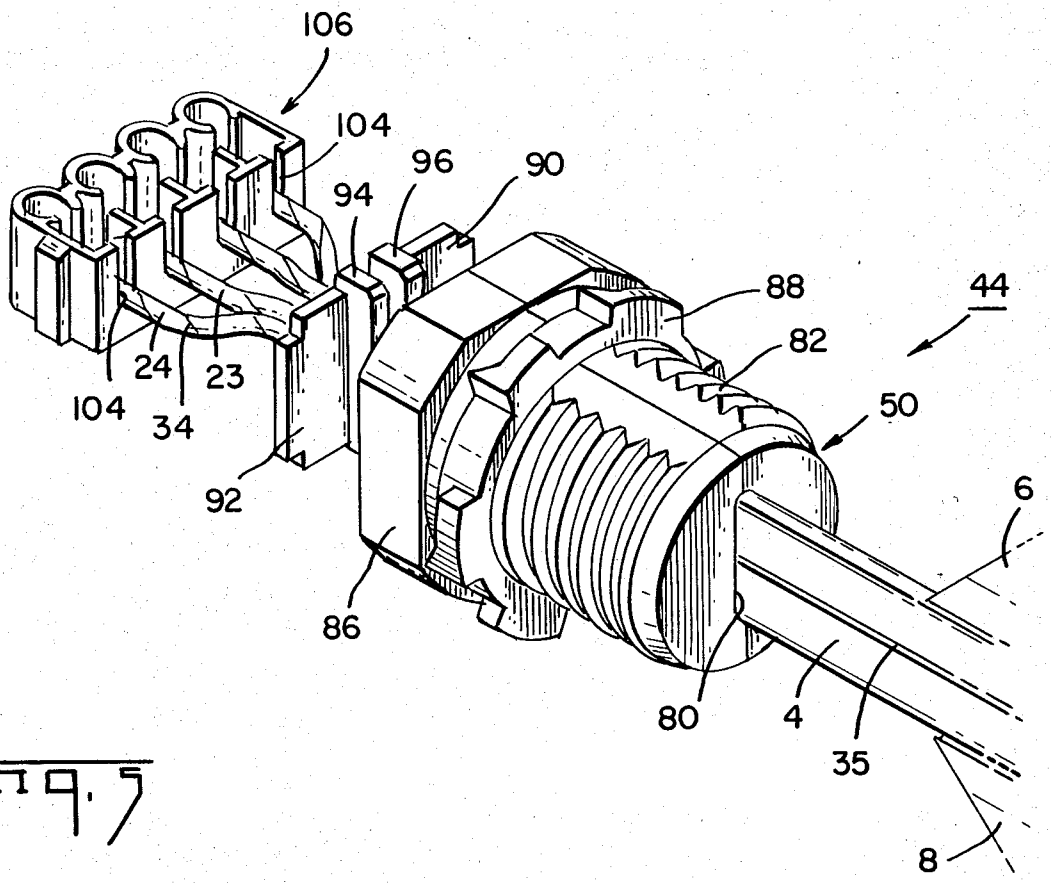

As can be seen in the drawings, particularly with reference to FIG. 2, the cable to be coupled is fabricated with a common symmetrical cross-sectional profile along its entire length with the conductors in a common plane. By virtue of its weakened sections 30 and 32 and inherent flexibility it can rest on the foor in a flat condition no matter which side is placed on the floor. With reference again to FIG. 2, both ends of the cable may be stripped for coupling the cable by the methods and apparatus of the type disclosed in U.S. patent application Ser. No. 716,772, filed Mar. 27, 1985, entitled STRIPPING METHODS AND TOOLS FOR FLAT HIGH PERFORMANCE CABLE, filed concurrently herewith and assigned to the same assignee as the present application. The subject matter of that application is incorporated by reference herein.

Figure 10:
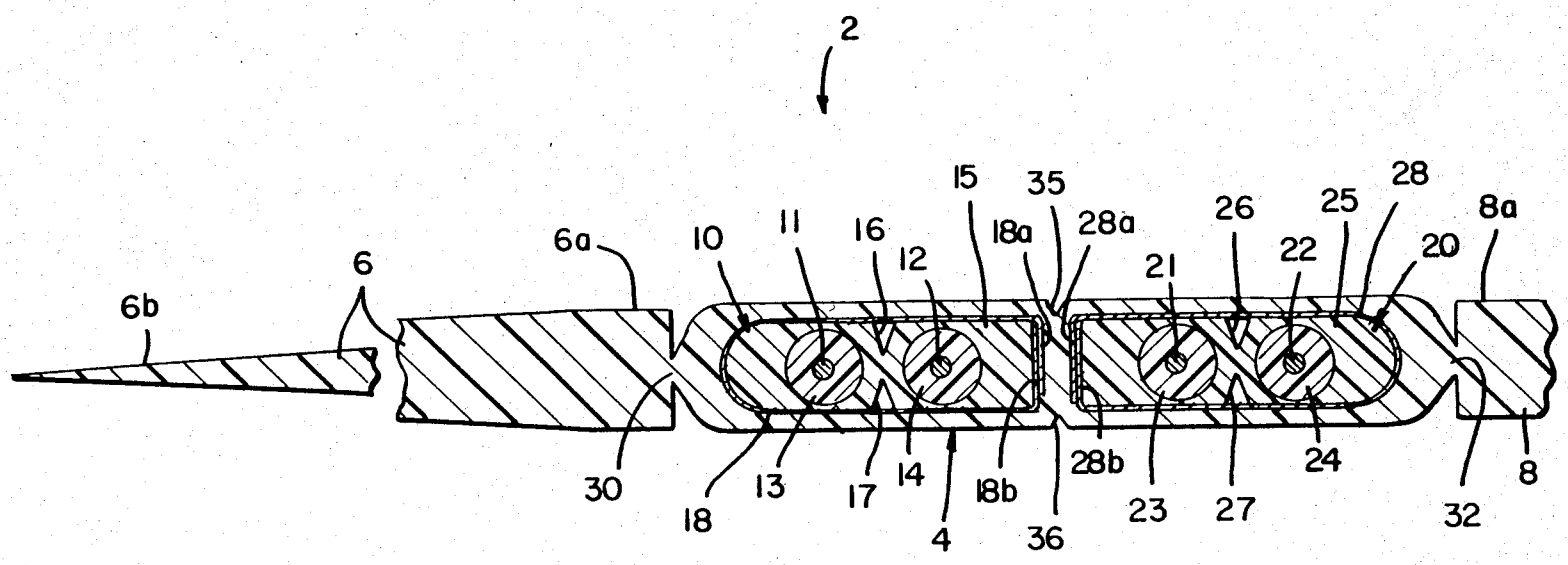
FIG. 10 is a cross sectional view of the cable.
Figure 11:
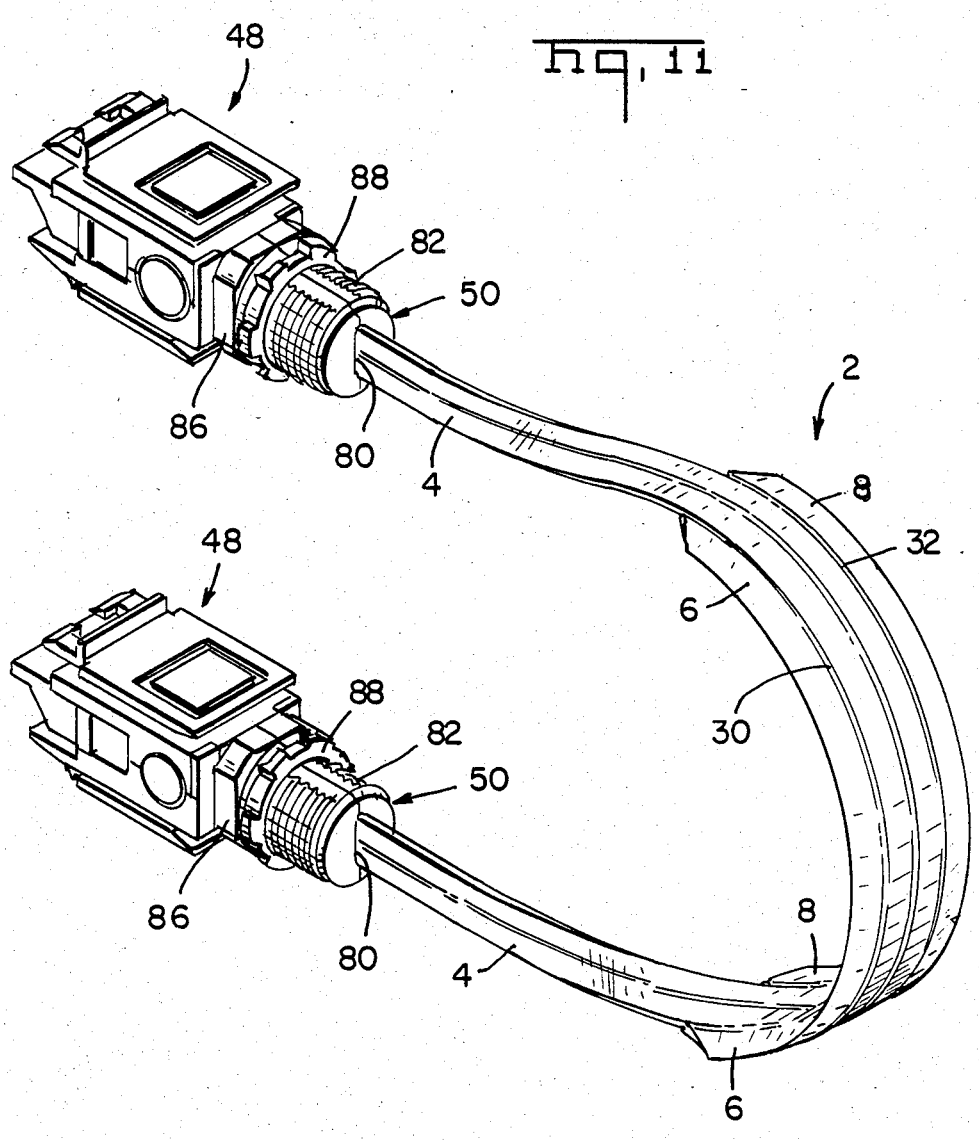
FIG. 11 is a perspective showing a cable section with connectors and adaptors attached at each end.

The cross-sectional configuration shown in FIG. 10 demonstrates the relative positioning of four wire conductors 11, 12, 21 and 22 in a flat cable assembly 2. Each of the conductors 11, 12, 21 and 22 employed in the preferred embodiment of this invention comprises a conventional round wire conductor. Conductors 11 and 12 comprise one associated pair of conductors while conductors 21 and 22 comprise a similar pair of associated conductors. Although each of the conductors 11, 12, 21 and 22 is positioned in the same plane, thus facilitating the low profile necessary for use in undercarpet installations, the two conductor pairs are nevertheless electrically balanced. Both of the conductor pairs are embedded in an outer insulating body 4 which comprises the central longitudinally extending portion or region of the cable 2. Similarly shaped wings or ramps 6 and 8 are bonded longitudinally along the opposite sides of the central body 4. Each of the wings 6 and 8 comprises an inclined surface to provide a smooth transition laterally of the axis of the cable, thus eliminating any sharp bump when the cable is positioned beneath a carpet. In the preferred embodiment of this invention, the insulating ramps 6 and 8 are formed from the same material as the insulating material which forms insulating body 4. Wings 6 and 8 are joined to body 4 along weakened longitudinally extending sections 30 and 32. In the preferred embodiment of this invention, the insulating material forming the body 4 and the insulating material forming wings 6 and 8 comprises an extruded insulating material having generally the same composition. A conventional polymer insulation such as polyvinyl chloride, PVC, comprises one material suitable for use in the jacket or body 4 and in the wings 6 and 8.

The surfaces or faces of the opposed central regions of the cable are parallel to each other. A continuation of such parallelism extends to a limited degree into the wings of the cable. This extending of the parallism into the wings provides for an extended thicker, horizontal section of the cable between the tapered regions of the wings when the cable is placed on the floor beneath a carpet. This design has been found to further distribute the forces from the carpet through the cable to the floor uniformly and reduce the external forces which would otherwise detrimentally act upon the wires and shield within the cable. As can be seen in FIG. 10, the transverse profile of the cable is low, and it is symmetric about both its central horizontal plane and its central vertical plane so that it may be employed with either face up reducing the chance for operator error during installation. The opposed faces of the central region of the body are essentially flat and are as thin as possible consistent with known fabrication techniques while allowing for the high electrical performance of the cable.

Each shielded cable pair is separately embedded within the insulation body 4. As shown in FIG. 2, the conductors 21 and 22 forming one pair 20 of associated conductors are surrounded or embedded within a separate insulating core 25 which is, in turn, embedded within the body 4 of cable 2. Each conductor 21 and 22 is, however, surrounded by a first insulation 23 and 24 respectively which comprises a foam-type insulation having a relatively low dielectric constant. An elastomeric foamable insulation such as polypropylene or polyehtylene, or any like material which can be fabricated with a large percentage of air trapped within the material, comprises a suitable dielectric material for use around the conductors in areas of relatively high dielectric field.

Following the fabrication of the insulation surrounding the conductors, and prior to the performing of additional processing steps thereon, the individual insulating wires are preferably striped or otherwise marked with discrete, visually identifiable indicia 34 such as a color coding. Indicia, such as a helical color coded stripe along the length of the insulator on its exterior surface allows for visual differentiation of the various wires of the cable as during termination and coupling of the cable wires to an electrical component such as a connector. In this manner, when the final cable is stripped in association with a termination process, the proper wires of the cable may be coupled with the proper element of the connector or the like.

These foam covered conductors may then be embedded within an insulating material 25, as by extrusion, which completely surrounds the foam insulation 23 and 24 in the immediate vicinity of the conductors. The insulating material 25 need not have as low a dielectric constant as the foam insulation 23 and 24, since the insulating material 25 is located in areas of relatively lower electric fields. The insulating material 25 must, however, be suitable for imparting dimensional stability and integrity to conductors 21 and 22 as well as to their surrounding insulation 23 and 24. In fact, in this invention the dielectric material 25 holds the conductors 21 and 22 in a parallel configuration along precisely spaced surfaces, edges and center lines with respect to the cable and with respect to each other. The insulating material forming the core 25 also comprises a material having greater strength when subjected to compressive forces than the foam type insulation 23 and 24 surrounding conductors 21 and 22. A material suitable for forming core 25 is preferably a conventional flexible polyvinyl chloride, PVC, which can be extruded around the foam insulation 23 and 24 surrounding conductors 21 and 22. It is desirable that the foam type insulation 23 and 24 not adhere to the extruded insulating material forming the core 25 since the conductors must be removed from the core 25 for conventional termination into an adaptor and connector.

Longitudinally extending notches 26 and 27 are defined along the upper and lower surfaces of the core 25. These notches, which can be conveniently formed as part of the extrusion through the appropriate design of the die are located in areas of relatively low dielectric field and define a weakened section of insulating core 25 to permit separation of conductors 21 and 22 for termination purposes. Formed into the upper and lower surfaces of the body 4 are central notches 35 and 36 extending the length of the core along the centerline. Similar to the notches 26 and 27 in the core 25, central notches 35 and 36 constitute weakened sections in the insulating body 4 to permit an operator to separate, by hand, one conductor pair from another. These central notches are naturally formed during the cooling process following the extrusion since a greater quantity of shrinkable PC is located in the body 4 between the upper and lower notches as compared with the quantity of insulator immediately to either side thereof.

The electrical performance of each pair of conductors is greatly enhanced by the use of EMI shields 18 and 28 encircling the cores 15 and 25 of the conductors within each conductor pair 10 and 20. As shown in FIG. 10, an EMI shield 28 can be positioned in partially encircling relationship to conductors 21 and 22 within insulating core 25. The ends 28A and 28B of EMI shield extend beyond the lateral edge of core 25 during fabrication of the cable.

An annealed metallic foil is employed as the EMI shields 18 and 28. For example, an annealed copper foil having about a 2 mil thickness is suitable for use as an EMI shield in the preferred embodiment of the invention.

The present invention is an adaptor 44 including a ferrule 46 to allow an operational electrical connection between the wires and EMI shield of a stripped cable end and a connector 48 functionally equivalent to, and of essentially the same design as that disclosed in U.S. Pat. No. 4,449,778.

The adaptor of the present invention includes a body 50 which is formed of two essentially identical halves or portions 52 and 54. According to the disclosed preferred embodiment of the invention, the halves are axially split and are provided on their mating surfaces with male projections 56 and associated female receptors 58, pins and apertures, to affect appropriate and accurate alignment of the halves when joined. The halves are different ony in that one half contains, at its front or outboard end 60, the male mating projections and, at its rear or inboard end 62, the female apertures. The other segment has, at its outboard end, the female apertures and, at its inboard end, the male projections.

As used herein, the term inboard is intended to mean that axial end of the adaptor away from the connector or toward that end when viewed from the adaptor. The term outboard is intended to mean that end of the adaptor closer to the connector or toward that end when viewed from the adaptor.

In addition to the above described adaptor halves, the adaptor also includes a ferrule 46 in the form of an essentially cylindrically shaped hollow member. The open ends 64 and 66 of the ferrule, both inboard and outboard, are turned outwardly to form ribs 68. These ribs are thus located at the axial ends of the ferrule to provide rigidity to the ferrule as during handling, installation or use.

Both adaptor body segments have undercut central cavities to form a recess 70 axially bounded by slots 72 and 74. The recess and slots are of such size and position as to receive the ferrule which contains, internally therethrough, pairs of insulated wires and their second or intermediate insulating covering. Externally thereof, the ferrule receives crossed pairs of conductive strips 76, extensions of the EMI shields, both above and below.

The exterior surface of the adaptor is provided with threads 82 which are tapered to increase in diameter as they move outboardly. Adjacent the greatest diameter threads, approximately mid span of the adaptor is an abutment shoulder 84 next followed by an enlarged, nut-like surface 86 grippable by a wrench. The abutment shoulder limits the extent that the nut 88 may be rotated along the threads toward the outboard end of the halves. The nut-like surface constitutes an area where an operator may grip, normally mechanically with a wrench, the halves while gripping and rotating the nut along the threads, again normally mechanically with a second wrench.

In assembling the cable end to the adaptor, a nut 88 is first axially slid down the free end of the cable. The adaptor halves are then mated with a section of the second insulator from adjacent the stripped end of the cable spanning the axial ends of the adaptor. Axial movement of the cable within the adaptor is precluded due to the frictional holding forces of the apertures acting upon the ends of the cable within the adaptor and by the projections extending into the cable. The threads of the adaptor are, of course, inboard of the free ends of the wires with the wires and exposed insulators just beyond the outboard end of the adaptor. The nut is then screwed onto the adaptor threads. Pliers are normally utilized to fixedly hold the grippable portion 86 of the adaptor while an operator rotates the nut with another pliers toward the abutment shoulder with sufficient force until the segments of the adaptor are in tight mating contact.

As the halves are drawn together with the ferrule therebetween, sufficient force is being exerted to deform the ferrule to essentially conform to the shape of the recess. Compressed between the ferrule and the recess of one half is a first crossed pair of conductive strips of the EMI shields. These conductive strips of the EMI shield are formed as the cable is stripped and prepared according to the method disclosed in the aforementioned U.S. patent application Ser. No. 716,772, filed Mar. 27, 1985, entitled Stripping Methods and Tools for Flat High Performance Cable filed concurrently herewith. Compressed between the ferrule and the recess of the other half is a second crossed pair of conductive strips of the EMI shield. This relationship makes for an effective grounding of the EMI shield within the adaptor. FIGS. 8 and 9 are cross-sectional views of the ferrule and associated parts taken before and after the application of these compressive forces and illustrate the extent of the compression of the ferrule within the recess. The coupling of the ferrule to the adaptor may now be considered complete.

The materials of the adaptor halves and the ferrule must be sufficiently electrically conductive so as to ground the EMI shield when the apparatus is in use. Die cast zinc aluminum or the equivalent has been found suitable for the halves of the adaptor body while copper has been found suitable for the ferrule.

The outboard end of the adaptor is provided with inboard and outboard spaced coupling plates 90 and 92 which together constitute the mounting brace. These plates are secured at their bases to intermediate, outboardly extending support plates 94 and 96. These support plates extend from the outboard end of the halves and are located on opposite sides of the aperture 78 so that the wires may extend therepast for connection to the connector.

Note is also taken that the wires of the cable are in a vertical orientation as they pass through the adaptor. This is necessitated due to the need of the wires to pass beyond the spaced plates. A horizontal orientation of the wires and cable would cause an interference between the support plate and their associated parts on the connector.

Figure 6:
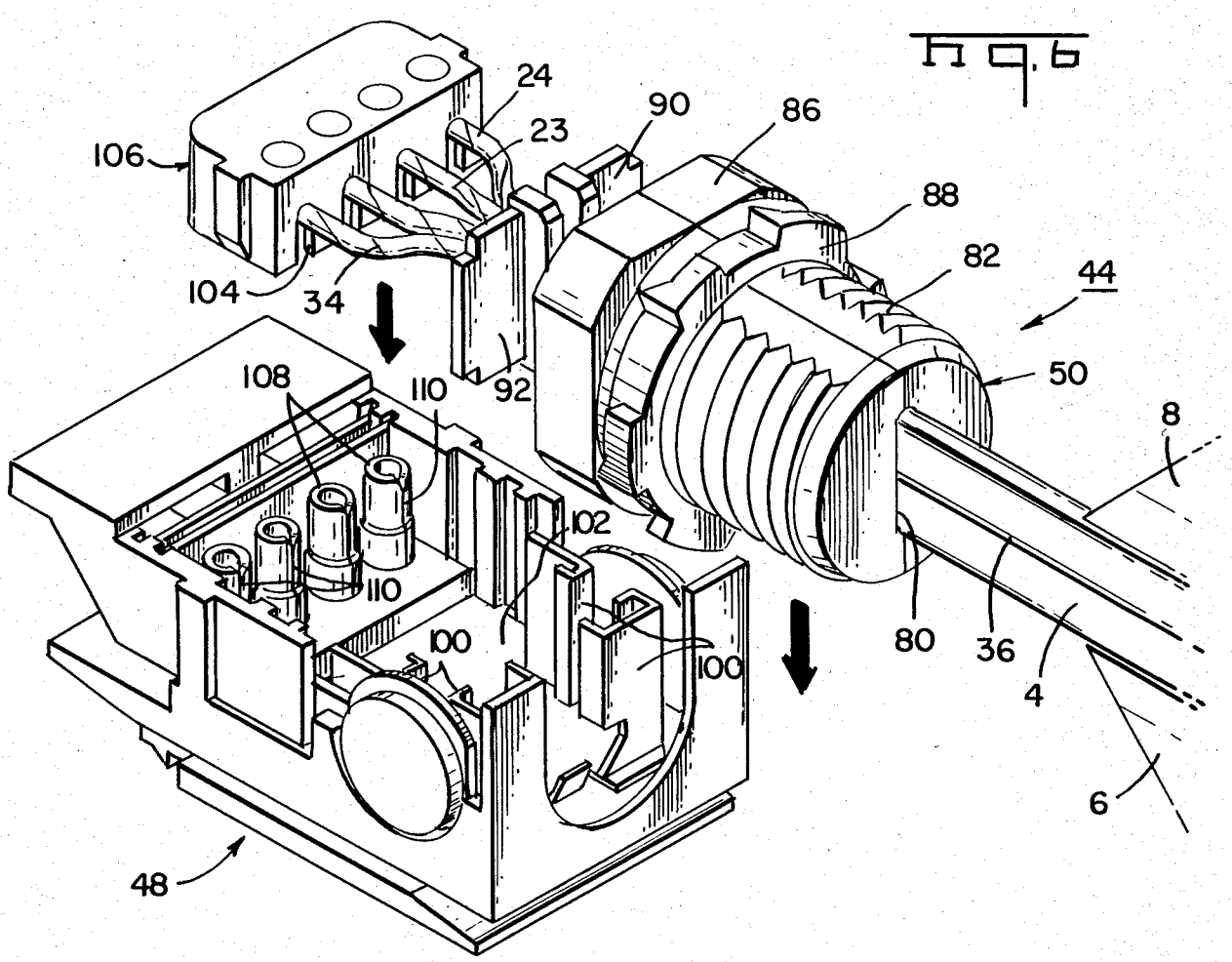

Coupling of the adaptor to the connector is effected by sliding the spaced plates over spring urged, electrically grounded projections 100 extending from the base 102 of the connector EMI shield positioned within the connector space 48. This action is shown in FIG. 6. Note the direction of the arrows which indicate the direction of movement of the adaptor and connector with respect to each other.

Figure 7:
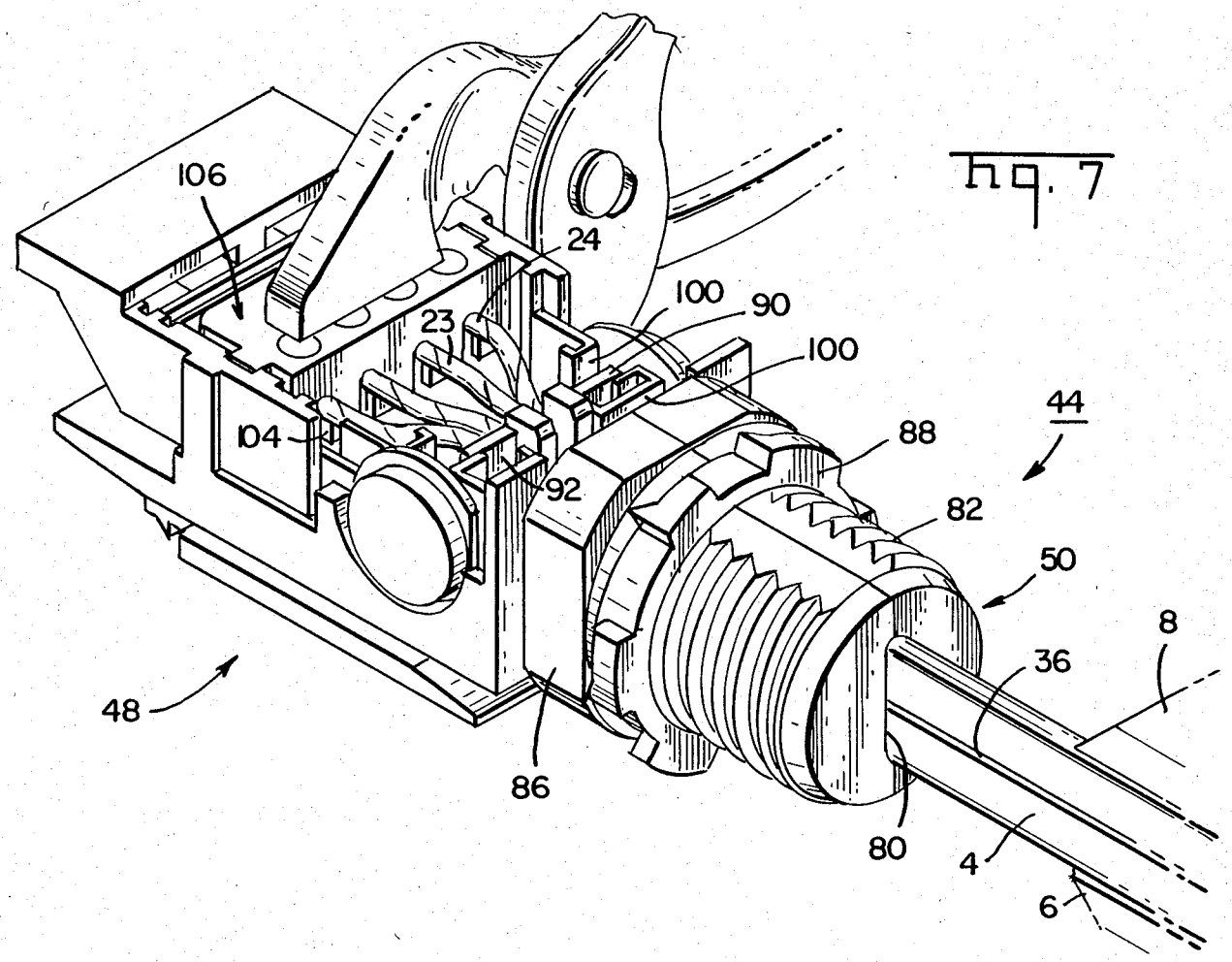

Prior to coupling the spaced support plates 90 and 92, the indicia bearing insulated wires may be placed into appropriate slots 104 of the stuffer 106. The stuffer is then positioned over the terminals 108 of the connector whereat slits 110 pierce the foam insulation of the wires during sliding engagement to make electrical contact between the terminals and the wires. This occurs upon application of sufficient force between the stuffer and the base of the connector as applied from a pliers of an operator. This action is shown in FIG. 7. As positioned in the terminals 108, the conductors are oriented in a plane which is then perpendicular to the plane of the associated conductor pairs in the flat cable. Further details of the connector and its coupling to cable wires and to a component of an electrical system can be had by reference to the patent to Lane.

Although the invention has been described in terms of a single embodiment and additional extensions of this invention have been discussed, it will be appreciated that the invention is not limited to the precise embodiment disclosed or discussed since other embodiments will be readily apparent to those skilled in the art.

What is claimed is:

1. For use in joining a plurality of conductive wires of a cable to a connector, an adaptor comprising:

a generally cylindrically shaped, hollow, ferrule through which the insulated wires of a cable may pass, an electrically conductive adaptor body formed of separable portions shaped for mating engagement one with another, each portion having an internal recess for the receipt of said ferrule therein, and comprising means for providing electrically grounded contact with ground strips of the cable, the adaptor including coupler plates on the outboard ends of said separable portions for the securement and grounding of the adaptor to a connector, and securement means to hold said portions of said body in operative engagement of said ferrule located within said recesses of the adaptor body.

2. The adaptor as set forth in claim 1 wherein said securement means includes tapering threads formed on the inboard end of said separable portions and a nut with internal threads to engage said tapering threads to releasably couple said separable portions.

3. The adaptor as set forth in claim 2 and further including shoulder means on said separable portion to limit the rotational movement of said nut with respect to said separable portion.

4. The adaptor as set forth in claim 1 wherein said separable portions, when secured together by said securement means, form a first aperture at the inboard end of the adaptor and a second aperture at the outboard end of said adaptor for frictionally securing a cable segment passing through said adaptor.

5. The adaptor as set forth in claim 4 wherein said separable portions further include:

at least one female receptor operatively coupled with at least one male projections for piercing a cable extending between said first and second apertures to preclude longitudinal movement of a cable segment with respect to the adaptor.

6. Apparatus for the transmission of electrical signals between separate circuit segments comprising:

a cable having at least one signal conductor and a surrounding EMI metallic foil shield, the EMI shield being separated at one end into first and second pairs of strips;

a shielded connector comprising means for electrically interconnecting one or more signal conductors to another circuit segment;

a ferrule, at least one signal conductor extending through the ferrule, the EMI shield strips being deployed only on the exterior of the ferrule; and a body secured around the ferrule comprising means for conductively engaging the EMI shield to ground the EMI shield to the body, whereby signal transmission between interconnected signal segments is maintained without significant radiation.

7. The apparatus of claim 6 wherein a pair of signal conductors extend through the ferrule and are connected to the connector.

8. The apparatus of claim 6 wherein the body is formed of an electrically conductive material and the shielded connector comprises a connector EMI shield, the body having means for conductively engaging the connector EMI shield.

9. The apparatus of claim 6 further comprising a second shielded connector, a second ferrule and a second body attached to the opposite end of the cable.

10. The apparatus of claim 6 wherein each EMI shield strip on the exterior of the ferrule is crossed with an adjacent EMI shield strip.

11. The apparatus of claim 10 wherein the body comprises two mating separable portions having internal recesses therein, the ferrule conforming to the internal recesses, a first crossed pair of EMI shield strips extending between the ferrule and one separable body portion, a second crossed pair of EMI shield strips extending between the ferrule and the other separable body portion.

12. The apparatus of claim 11 further comprising tapered securement means on the exterior of the separable body portions for deforming the ferrule to compress the EMI shield strips between the ferrule and the body portions.

13. For use in joining a plurality of conductive wires of a cable to a connector, an adaptor comprising:

a generally cylindrically shaped, hollow, ferrule through which the insulated wires of a cable may pass, an electrically conductive adaptor body formed of separable portions shaped for mating engagement with one another, each portion having an internal recess for the receipt of said ferrule therein, and comprising means for providing electrically grounded contact with grounding strips of the cable, and tapered securement means on the exterior of the separable portions increasing in diameter toward the outboard end and comprising means for drawing the separable portions of the adaptor body into tight mating contact to deform the ferrule to conform to the shape of the internal recesses.

14. The adaptor of claim 13 wherein the tapered securement means comprise tapered threads and a nut with internal threads engaging the tapered threads.

15. For use in joining a cable containing a plurality of conductive wires surrounded by a cable shield to a shielded connector comprising:

a generally cylindrically shaped, hollow, ferrule through which the insulated wires of a cable may pass;

an adaptor body formed of separable portions shaped for mating engagement one with another in surrounding relation to the cable, separable portions in mating engagement defining a first aperture at the inboard and a second aperture at the outboard end, through which a segment of the cable can extend, the separable portions further including at least one female receptor operatively coupled with at least one male projection for piercing the cable extending through the first and second aperture to preclude longitudinal movement of a segment of the cable with respect to the adaptor; and securement means for holding the separable portions of the body together.

16. The adaptor of claim 15 wherein the adaptor body is electrically conductive, each body portion having an internal recess for receipt of the ferrule therein, and comprising means for providing electrically grounding contact with the cable shield, the portions of the body being held in operative engagement with the ferrule located within the recesses of the adaptor body by the securement means.

17. The adaptor of claim 15 wherein the securement means comprises means for applying a force on the separable portions to draw the separable portions into a tight mating contact.

18. The adaptor of claim 17 wherein the securement means comprises threads between the inboard and outboard adaptor ends and a nut rotatable on the threads.

19. The adaptor of claim 17 wherein the securement means comprises means to deform the ferrule.

20. The adaptor of claim 19 wherein the securement means comprises means tapered to increase in diameter toward the outboard end.

21. The outboard of claim 20 wherein the securement means comprises tapered threads between the inboard and outboard end and a nut rotatable on the tapered threads.

* * * * *